US009828148B2

(12) United States Patent
Schreckenhoefer et al.

(10) Patent No.: US 9,828,148 B2
(45) Date of Patent: Nov. 28, 2017

(54) CONTAINER WITH A SECURING DEVICE

(71) Applicant: KOCHER-PLASTIK MASCHINENBAU GMBH, Sulzbach-Laufen (DE)

(72) Inventors: Manfred Schreckenhoefer, Sulzbach-Laufen (DE); Alexander Hammer, Gaildorf (DE)

(73) Assignee: KOCHER-PLASTIK MASCHINENBAU GMBH, Sulzbach-Laufen (DE)

( * ) Notice: Subject to any disclaimer, the term of this patent is extended or adjusted under 35 U.S.C. 154(b) by 0 days.

(21) Appl. No.: 15/123,319

(22) PCT Filed: Mar. 5, 2015

(86) PCT No.: PCT/EP2015/000497
§ 371 (c)(1),
(2) Date: Sep. 2, 2016

(87) PCT Pub. No.: WO2015/135636
PCT Pub. Date: Sep. 17, 2015

(65) Prior Publication Data

US 2017/0066574 A1 Mar. 9, 2017

(30) Foreign Application Priority Data

Mar. 14, 2014 (DE) ..... 10 2014 003 487

(51) Int. Cl.
*B65D 50/06* (2006.01)
*A61J 1/06* (2006.01)
(Continued)

(52) U.S. Cl.
CPC ..... *B65D 50/06* (2013.01); *A61J 1/067* (2013.01); *B65D 1/0238* (2013.01); *B65D 1/095* (2013.01); *B65D 69/00* (2013.01)

(58) Field of Classification Search
CPC ..... B65D 50/06; B65D 50/067; B65D 17/24; B65D 21/0201; B65D 21/0202;
(Continued)

(56) References Cited

U.S. PATENT DOCUMENTS

2005/0045579 A1 3/2005 Weiler et al.
2009/0101650 A1 4/2009 Hansen
(Continued)

FOREIGN PATENT DOCUMENTS

CH 667 440 10/1988
DE 20 2004 017 346 2/2005
(Continued)

OTHER PUBLICATIONS

Translation of CH667440 (SPORI), Oct. 14, 1988, pp. 5-6.*
International Search Report (ISR) dated May 29, 2015 in International (PCT) Application No. PCT/EP2015/000497.

*Primary Examiner* — Robert J Hicks
(74) *Attorney, Agent, or Firm* — Wenderoth, Lind & Ponack, L.L.P.

(57) ABSTRACT

A blow-molded plastic container has a storage part (4) for receiving a medium to be dispensed via a container opening (10) and a head part (6) removably connected to the storage part (4) via a separation point (12) and releasing the container opening (10) for removing the medium after the head part has been separated from the storage part (4). The separation of the head part (6) from the storage part (4) is completely prevented or hindered by a securing device (16) in a securing position. The head part (6) can be removed from the storage part (4) without force via the separation point (12) in a release position of the securing device.

22 Claims, 2 Drawing Sheets

(51) Int. Cl.
*B65D 1/02* (2006.01)
*B65D 1/09* (2006.01)
*B65D 69/00* (2006.01)

(58) Field of Classification Search
CPC ..... B65D 51/18; B65D 69/00; B65D 1/0238; B65D 1/023; B65D 1/02; B65D 1/095; B65D 41/32; B65D 41/62; B65D 55/02; B65D 35/44; B65D 83/0463; B65D 83/06; A61J 1/067
USPC ... 220/212.5, 265, 266, 260, 263, 262, 23.4, 220/23.2; 215/228, 252, 253, 251, 250, 215/258, 48, 47; 206/532, 528, 807, 1.5; 53/492
See application file for complete search history.

(56) References Cited

U.S. PATENT DOCUMENTS

| | | | | |
|---|---|---|---|---|
| 2010/0326022 | A1* | 12/2010 | Colangelo | B65D 1/0238 53/492 |
| 2013/0098864 | A1* | 4/2013 | Fontana | A61J 1/067 215/250 |
| 2016/0137367 | A1* | 5/2016 | Fontana | B65D 1/0238 206/532 |

FOREIGN PATENT DOCUMENTS

| | | |
|---|---|---|
| DE | 601 08 867 | 4/2006 |
| DE | 10 2006 015 913 | 10/2007 |
| EP | 1 826 128 | 8/2007 |
| WO | 2007/112802 | 10/2007 |

* cited by examiner

CONTAINER WITH A SECURING DEVICE

FIELD OF THE INVENTION

The invention relates to a container with a safety device, in particular, in the form of a blow-molded plastic container, preferably in the form of an ampoule. The container comprises a storage part for receiving a medium that can be dispensed via a container opening and comprises a head part releasably connected to the storage part via a separation point. The head part releases the container opening for a removal process of the medium after the head part has been separated from the storage part.

BACKGROUND OF THE INVENTION

Containers with such safety devices are appropriate or even essential in situations where preventing easy dispensing of the medium from the container is necessary. More specifically, the safety device is to prevent dispensing from taking place without having to undertake special measures to release the container opening. Complicating the removal of the contents of a container in question by using a safety device is necessary, in particular, as a child safety feature, when the container contains hazardous media and contact therewith or even oral consumption thereof would be fatal at least to a certain category of persons, for example, children. On the other hand, such a child safety feature, should not constitute so great an obstacle that older people, for example, can no longer access the container contents.

The present container solution is, in particular, produced according to a blow molding, filling and sealing process as it has now become known globally under the brand name Bottelpack®. Container products produced according to the known Bottelpack® method are produced in one piece from plastic, filled and then sealed preferably in sterile form. Such containers, which can also be in ampoule form, often contain dispensing media, mainly in the form of fluids for therapeutic purposes, which are intended for use by certain persons only which, in principle, necessitates a child safety feature.

A generic container with a safety device is disclosed in WO 2007/112802 A1. The container opening can be sealed by a first safety part, which opposes an opening force with a pre-definable resistance. This pre-definable resistance may be overcome with the aid of a second safety part cooperating with the first safety part to release the container opening. In the case of the known solution, the pre-definable resistance can be selected such that, without the assistance of the second safety part, it is virtually impossible to overcome, or at least cannot be overcome by children. This arrangement makes a simple or unintentional opening more difficult and, in particular, ensures that children are not able to readily perform the operation sequence required to open the container opening without instructions.

A disadvantage of this known solution is that the safety device is designed as an auxiliary tool as the one safety part which, removed from the container, enables the actual opening process only by using this auxiliary tool to separate the head part as the other safety part from the storage part of the container via the separation point and, in this way, then releasing the container opening for a removal of media from the container. Aside from the possibility of the actuation tool becoming lost as a result of its removal from the container, improper user application of the tool in question cannot be ruled out, thus resulting in additional difficulties for the opening process.

Also, older users, in particular, may find the known child safety features too challenging and may be unable to initiate an opening process.

SUMMARY OF THE INVENTION

An object of the invention is to provide an improved safety device, which is practically constructed with respect to the actuation and functions without an additional actuation tool.

This object is basically achieved by a container with a safety device, where the separation of the head part from the storage part is completely prevented or at least complicated by the safety device in a safety position. In at least one release position, the head part can be easily removed from the storage part via the separation point. A safe opening process for the storage part can be achieved without tools using the container itself. In particular, all safety device parts required for this process can permanently remain on the container, so that no parts can become lost during unlocking either. The solution according to the invention is comprehensibly designed, so that older citizens in particular have no problems with opening the container and can easily manage the opening of the first container, which is equipped with such a safety device. Only children in the age range in question, are unable to easily accomplish opening without instructions from adults. This safety concept has no equivalent in the prior art.

In a particularly preferred embodiment of the container solution according to the invention, the safety device has a securing bracket that, in the safety position, at least partially spans the head part in the manner of a bracket. In the respective release position, the securing bracket assumes a pivot position opposite the storage part, which pivot position releases the head part for an actuation, in particular for its manual removal from the storage part. The securing bracket is easily haptically identifiable and can be moved with pre-definable actuation forces from its safety position to the release position.

Particularly preferably, the securing bracket is pivotably linked to the storage part via its two ends facing the storage part by linkage points. The securing bracket then does not, as the one safety part, become lost even after actuation. Together with the emptied container and with the separated head part as the other safety part, all parts can be disposed of as a single unit. In particular, no need exists for complex opening processes using a separate actuation tool that is initially an integral component of the container solution (WO 2007/112802 A1).

Another preferred embodiment of the container according to the invention provides that the linkage points abut a frame of the storage part, which frame defines a midplane for the container. The wall thickness of the frame is selected thinner than the wall thickness for the securing bracket. Because the containers or ampoule products are, in the known Bottelpack® production method, filled via mold halves that can be separated from one another with a plastic material of an extruded plastic hose, the safety device can easily be formed as a negative mold by a simplified cavity formation in the mold half pairs. Then, in the blow molding process as, a positive form produces the actuatable safety device for the respective container product. Because the securing bracket with its reinforced side wall forms the rest of the frame of the storage part for the container product, a very good contact surface for the manual unlocking of the safety device is provided. In addition, the frame of the container storage part is reinforced in the safety position by the securing bracket wall such that protection is simultaneously provided against damage to the container, in particular, in the head part region from a possible third party influence.

Furthermore preferably, the two linkage points are disposed diametral to a longitudinal axis of the container and are formed as trunnions. The respective linkage point is disposed in an area of the container, in which a cylindrical neck part of the storage part transitions into a conical taper, which conical taper ends at the container opening. Because of this design, a release of the safety device involves easily being able to pivot the pivot bracket, in both possible opposite deflection directions, away from the container opening with the head part.

Further particularly preferably, the free pivot path of the securing bracket can pivot from a zero position relative to the longitudinal axis of the container, which corresponds to the safety position, into an unlocked position, which corresponds to the release position, which varies from the zero position by at least 90° of pivot. This pivot path ensures, in any case, that the head part can be separated easily and unhindered from the container opening along the separation point after release of the safety device, with the securing bracket preferably being able to be pivoted back still further, preferably as far as a contact with the other wall parts of the container body. A simplified manipulation during removal with just one of the user's hands is then ensured.

Because the securing bracket in its safety position is preferably releasably fixed by at least one connection part along the outer contour of the head part and/or of the neck part, in conjunction with the molding process a separation line can be created for the container product between head part and securing bracket. The separation line permits an unimpeded pivoting away or folding back of the securing bracket from the head part, while reliably holding the securing bracket in the zero position, provided no external actuation force separates the respective connection point. The connection is designed as a predetermined breaking point, with a pre-determinable actuation force.

Containers in ampoule form of the aforementioned type are often marketed in the form of "multiblocks" made up of several ampoules linked together. This design contributes further to child safety by requiring, as a further complication of the opening process, a prior manual separation of the container from the ampoule block, again using pre-determinable actuation force. Because, in the solution according to the invention, the securing bracket with its outer contour in the safety position forms a partial frame in the manner of a card part, which at least partially surrounds the storage part, and because the container is releasably connected via a separation point between neighboring card-type frames with at least one neighboring container, the securing bracket is, in the context of the multiblock formation, an integral component of the card design for the multiblock, which integral component helps to simplify the production process.

According to the method according to the invention, to release the container opening, the securing bracket of the safety device must firstly be pivoted from its safety position or zero position so far away from the head part that the manipulation part of the head part or the head part itself can be twisted away from the container opening by a user via the separation point. This opening may be achieved by a relative twisting movement between head part and storage part before the medium dispensing is initiated via the released container opening. The storage part with the pivoted back securing bracket can be held with one hand while twisting the head part with the other hand. This twisting movement can be initiated by an opposite rotation of head part and storage part, or the head part can be held and the storage part can be appropriately twisted, the foregoing being more easily implementable because the storage part as the larger container part can be securely clasped by the user's actuation hand.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure and that are schematic and not to scale.

DETAILED DESCRIPTION OF THE INVENTION

Figure 2:
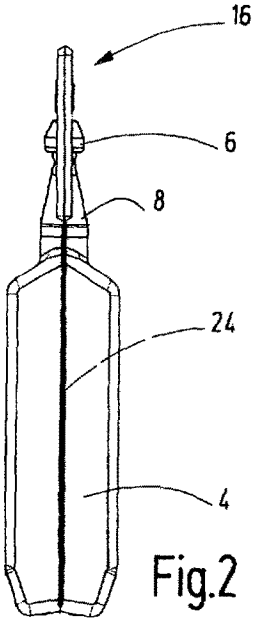
FIGS. 1 to 3 are a front view, a side view and a top view, respectively, of a multiblock made up of several container units according to an exemplary embodiment of the invention.
Figure 1:
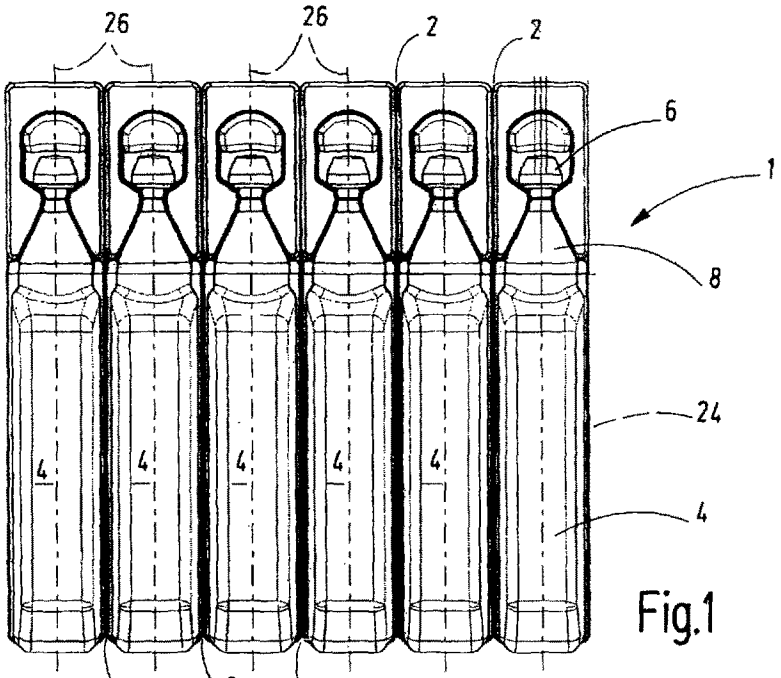
Figure 3:
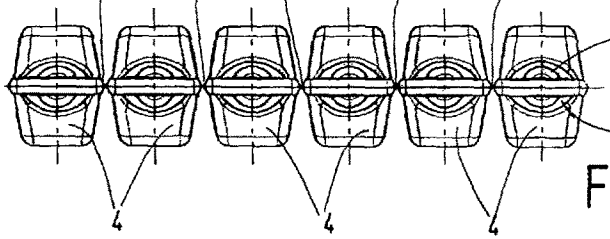

The invention is explained in greater detail below with reference to an exemplary embodiment according to FIGS. 1 to 8, in which the safety device in the form of a child safety feature complicates the opening process for plastic containers in ampoule form made from blow-molded plastic. Such ampoules can be produced in one piece, filled in a sterile manner and sealed using the Bottelpack® method, for example. Such ampoules or containers can be marketed collectively as a multiblock 1, particularly preferably as a unit of several ampoules. In FIGS. 1 to 3, a multiblock 1 has six ampoules joined at separation points 2. Each ampoule or container has, viewed in cross section, a polygonal storage part 4 (FIG. 3) with an upper head part 6, which extends in the direction of a container opening 10, while forming a conical narrowing or tapering in the form of a neck part 8. As can be seen in particular from FIGS. 4 to 8, the head part 6 is releasably connected, by a separation point 12 of the predetermined breaking point type to the neck part 8, which neck part surrounds the container opening 10 at this point. The head part 6 can be separated or sheared off (twist-off-cap) from the front upper end of the head part 6 by a manipulation part 14. After separation of the head part 6, the container opening 10 is released accordingly, and a dispensable medium can be removed from the storage part 4 via the container opening 10.

Furthermore, the container solution according to the invention is equipped with a safety device 16 which, in a safety position shown in FIGS. 1 to 3 and 4, completely prevents or at least complicates the separation of the head part 6 from the storage part 4 with the neck part 8. In the safety position, manually twisting off the head part 6 via the separation point 12 and removing it in the upwards direction, as viewed in the viewing direction of the figures, is not possible. In at least one release position, as is depicted in FIGS. 5 to 8, the head part 6 can be easily removed from the storage part 4 via the separation point 12. The head part 6 is still in its sealed position according to FIGS. 5 and 6. In FIGS. 7 and 8, the container opening 10 is released, and the head part 6 is already removed.

The safety device 16 has a securing bracket 18. In the safety position, securing bracket 18 at least partially spans the head part 6 in the manner of a bracket along the free outer circumference of head part 6. With the securing bracket 18 assuming in its pivoted, release position opposite the storage part 4, the head part 6 is released for an actuation, in particular, for its removal from the storage part 4. This folded back release position is illustrated in FIGS. 5 to 8.

The securing bracket 18 is pivotably linked to the storage part at its two ends facing the storage part 4 by linkage points 20. The linkage points 20 abut a frame 22 of the storage part 4, which defines a midplane 24 for the container. The wall thickness of frame 22 (cf. FIG. 2) is selected thinner than the wall thickness for the securing bracket 18.

Figures 4, 5, 6, 7, 8:
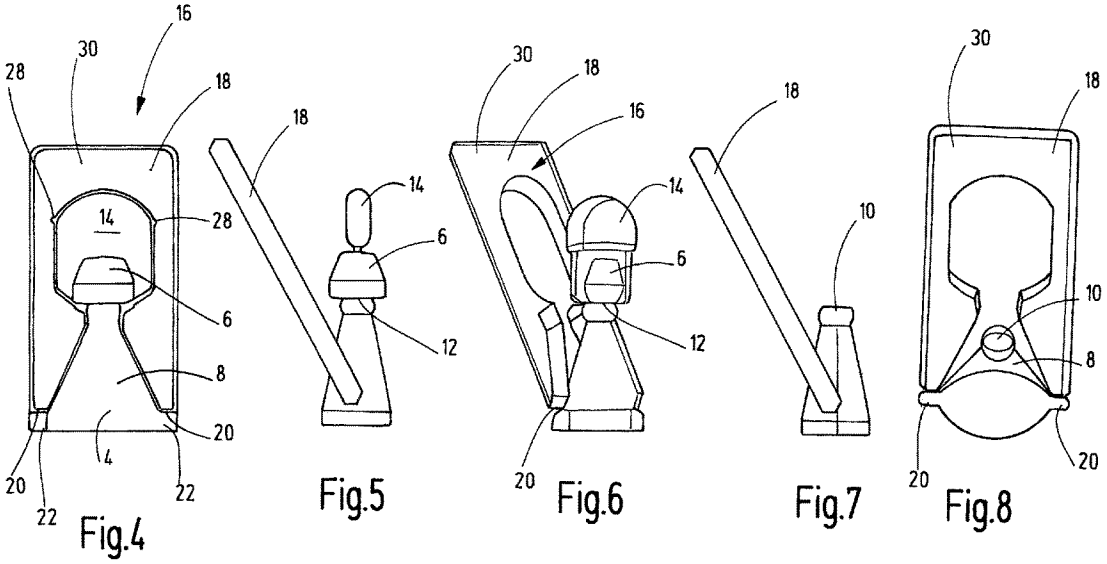
FIGS. 4 to 8 are front, side, perspective, side and perspective views, respectively, of the safety device for the container according to FIGS. 1 to 3 in different actuation positions, with, for the sake of simpler depiction, only the upper part of the container being shown without the actual container body forming the storage part.

As is seen in particular from FIG. 4, the two linkage points 20 are disposed diametral to a longitudinal or vertical axis 26 of the container, and they are formed as trunnions (cf. FIG. 8). In addition, the respective linkage point 20 is disposed in an area of the container in which a cylindrical part of the neck part 8 transitions into a conical taper of the neck part, which neck part ends at the container opening 10 (cf. FIGS. 5 and 6).

The free pivot path of the securing bracket 18, from the zero position, relative to the longitudinal or vertical axis 26 of the container, which corresponds to the safety position, into an unlocked position, which corresponds to the release position, can vary by at least 90°. The pivot position is preferably larger, however, and the securing bracket 18 can be pivoted back until it abuts at least with its upper end the upper side of container wall parts of the storage part 4. According to the depiction of FIGS. 5 to 8, the securing bracket 18 is, for the sake of simpler depiction, pivoted away from the longitudinal or vertical axis 26 of the container by approximately 30°.

As can also be seen from FIG. 4, the securing bracket 18 is, in its locked safety position depicted therein, releasably fixed or connected along the outer contour of the head part 6 and of the conically tapered neck part 8 by two connection parts 28, which form a type of predetermined breaking point. The securing bracket 18 then forms with its outer contour in the safety position a partial frame in the manner of a card part 30, which then at least partially also surrounds the storage part 4 in the area of the neck part 8. This solution requires punching the plastic material in this area, with the punching then excluding the connection parts 28. By the connection parts 28, the securing bracket 18 can be separated from the head part 6 in a predetermined breaking point manner.

Another option is to provide a reduction of the wall thickness in the plastic material along the depicted separation line between head part 6 and the neck part 8 and the card part 30 of the securing bracket 18. When manually perforated, the separation line can then release the securing bracket 18. As the depiction according to FIG. 1 shows, these card parts 30 of neighboring containers abut one another and form, together with the aforementioned separation points 2, two continuous separation areas, to allow individual containers to be appropriately separated from the multiblock arrangement according to FIG. 1. Such separation points 2 within the multiblock arrangement 1 likewise delimit frames 22, from which the storage part 4 with a pre-determinable storage volume then projects.

A method for releasing the container opening 10, which is provided in a container with a safety device 16, then proceeds as follows. Firstly, the securing bracket 18 of the safety device 16, after tearing through the connection parts 28, is pivoted out of its safety position and so far away from the head part 6 and the neck part 8 that, by the manipulation part 14, the head part 6 is twisted away from the separation point 12 by a user. The container opening 10 is then released (cf. FIG. 8). To ensure an interference-free removal process, the securing bracket 18 of the safety device 16 is manually pivoted back to an appropriate extent.

While one embodiment has been chosen to illustrate the invention, it will be understood by those skilled in the art that various changes and modifications can be made therein without departing from the scope of the invention as defined in the claims.

The invention claimed is:

1. A container, comprising:

a storage part receiving a medium that can be dispensed;

a head part releasably connected to said storage part by a separation point and forming an opening in said storage part for removal of the medium after separation of said head part from said storage part; and a safety device adjacent said head part at least complicating separation of said head part in a safety position of said safety device, said safety device being movable to a release position in which said head part can be easily removed from said storage part at said separation point, said safety device including a securing bracket at least partially spanning said head part in the safety position and being pivotable into the release position spaced from and allowing release of said head part from said storage part via said separation point.

2. A container according to claim 1 wherein said storage part, said head part and said safety device form a unitary, one piece blow molded plastic container.

3. A container according to claim 1 wherein said securing bracket is pivotably coupled to said storage part at two ends of said securing bracket facing said storage part by linkage points.

4. A container according to claim 1 wherein said securing bracket is releasably coupled by a connection part to an outer contour of one of said head part or a neck part extending between said storage part and said head part.

5. A container according to claim 1 wherein said securing bracket has an outer contour forming a partial frame in a card part shape and at least partially surrounding said storage part in the safety position.

6. A container according to claim 1 wherein the container is releasably connected via a separation point between neighboring card-shaped frames with a neighboring container.

7. A method for releasing a container opening, comprising the steps of:

pivoting a securing bracket of a safety device from a safety position adjacent a head part removably coupled to a storage part of a container at a separation point at least complicating separation of the head part from the storage part to a release position spaced from said head part allowing said head part to be easily removed from the storage part at the separation point; and manipulating the head part when the securing bracket is in the release position by a twisting movement to separate the head part from the storage part at the separation point to form an opening in the container for dispensing media in the storage part.

8. A container, comprising:

a storage part receiving a medium that can be dispensed;

a head part releasably connected to said storage part by a separation point and forming an opening in said storage part for removal of the medium after separation of said head part from said storage part; and a securing bracket adjacent and spanning said head part at least complicating separation of said head part in a safety position of said safety device, said safety device being pivotable to a release position spaced from said head part in which said head part can be easily removed from said storage part at said separation point.

9. A container according to claim 8 wherein said storage part, said head part and said safety device form a unitary, one piece blow molded plastic container.

10. A container according to claim 9 wherein said securing bracket is U-shaped and pivotably coupled to said storage part at free ends of said securing bracket facing said storage part.

11. A container according to claim 10 wherein said free ends abut said storage part at a midplane of said storage part.

12. A container according to claim 11 wherein said free ends are diametrical to a longitudinal axis of the container.

13. A container according to claim 8 wherein said securing bracket is releasably coupled by connection parts to an outer contour of said head part and said storage part.

14. A container, comprising:

a storage part receiving a medium that can be dispensed;

a head part releasably connected to said storage part by a separation point and forming an opening in said storage part for removal of the medium after separation of said head part from said storage part; and a safety device adjacent said head part at least complicating separation of said head part in a safety position of said safety device, said safety device being movable to a release position in which said head part can be easily removed from said storage part at said separation point, said safety device including a securing bracket at least partially spanning said head part in the safety position and being pivotable into the release position spaced from and allowing release of said head part from said storage part via said separation point, said securing bracket being pivotably coupled to said storage part at two ends of said securing bracket facing said storage part by linkage points, said linkage points abutting a frame of said storage part, said frame defining a midplane of said storage part and having a wall thickness thinner than a wall thickness of said securing bracket.

15. A container according to claim 14 wherein said storage part, said head part and said safety device form a unitary, one piece blow molded plastic container.

16. A container according to claim 14 wherein said linkage points are diametrical to a longitudinal axis of the container and comprise trunnions.

17. A container, comprising:

a storage part receiving a medium that can be dispensed;

a head part releasably connected to said storage part by a separation point and forming an opening in said storage part for removal of the medium after separation of said head part from said storage part; and a safety device adjacent said head part at least complicating separation of said head part in a safety position of said safety device, said safety device being movable to a release position in which said head part can be easily removed from said storage part at said separation point, said safety device including a securing bracket at least partially spanning said head part in the safety position and being pivotable into the release position spaced from and allowing release of said head part from said storage part via said separation point, said securing bracket being pivotably coupled to said storage part at two ends of said securing bracket facing said storage part by linkage points, said linkage points being disposed in an area of a neck part having a cylindrical section transitioning into a conically tapered section, said conically tapered section ending at said opening.

18. A container according to claim 17 wherein said storage part, said head part and said safety device form a unitary, one piece blow molded plastic container.

19. A container, comprising:

a storage part receiving a medium that can be dispensed;

a head part releasably connected to said storage part by a separation point and forming an opening in said storage part for removal of the medium after separation of said head part from said storage part; and a safety device adjacent said head part at least complicating separation of said head part in a safety position of said safety device, said safety device being movable to a release position in which said head part can be easily removed from said storage part at said separation point, said safety device being a securing bracket at least partially spanning said head part in the safety position and being pivotable into the release position spaced from and allowing release of said head part from said storage part via said separation point, said securing bracket being pivotably coupled to said storage part at two ends of said securing bracket facing said storage part by linkage points and being pivotable from a 0° angle relative to a longitudinal axis of the container in the safety position to at least a 90° angle relative to said longitudinal axis in the release position.

20. A container according to claim 19 wherein said storage part, said head part and said safety device form a unitary, one piece blow molded plastic container.

21. A container, comprising:

a storage part receiving a medium that can be dispensed;

a head part releasably connected to said storage part by a separation point and forming an opening in said storage part for removal of the medium after separation of said head part from said storage part; and a safety device adjacent said head part at least complicating separation of said head part in a safety position of said safety device, said safety device being movable to a release position in which said head part can be easily removed from said storage part at said separation point, said safety device comprises a securing bracket at least partially spanning said head part in the safety position and being pivotable into the release position spaced from and allowing release of said head part from said storage part via said separation point, said safety device including a securing bracket at least partially spanning said head part in the safety position and being pivotable into the release position spaced from and allowing release of said head part from said storage part via said separation point, said securing bracket being releasably coupled by connection parts to an outer contour of said head part and said storage part.

22. A container according to claim 21 wherein said storage part, said head part and said safety device form a unitary, one piece blow molded plastic container.

* * * * *